US006213075B1

(12) United States Patent
Ajayi et al.

(10) Patent No.: US 6,213,075 B1
(45) Date of Patent: Apr. 10, 2001

(54) ROLLER FOLLOWER ASSEMBLY FOR AN INTERNAL COMBUSTION ENGINE

(75) Inventors: Oyelayo O. Ajayi, Peoria; Theodore H. Becker, Jr., Chillicothe; Chuong Q. Dam, Peoria; Jian Zhang, Dunlap, all of IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/329,549

(22) Filed: Jun. 10, 1999

(51) Int. Cl.[7] ..... F01L 1/16

(52) U.S. Cl. ..... 123/90.42; 123/90.33; 123/90.5; 123/90.51; 123/508

(58) Field of Search ..... 123/90.42, 90.33, 123/90.48, 90.5, 90.51, 507, 508; 74/569

(56) References Cited

U.S. PATENT DOCUMENTS

| | | | | |
|---|---|---|---|---|
| 4,628,874 | | 12/1986 | Barlow | 123/90.5 |
| 5,186,130 | * | 2/1993 | Melchior | 123/90.35 |
| 5,239,951 | * | 8/1993 | Rao et al. | 123/90.5 |
| 5,398,648 | | 3/1995 | Spath et al. | 123/90.16 |
| 5,449,547 | | 9/1995 | Miyazaki et al. | 428/217 |
| 5,529,027 | * | 6/1996 | Okubo | 123/41.01 |
| 5,544,626 | | 8/1996 | Diggs et al. | 123/90.16 |
| 5,582,414 | | 12/1996 | Miyazaki et al. | 277/235 A |
| 5,588,413 | | 12/1996 | Stone et al. | 123/508 |
| 5,601,293 | | 2/1997 | Fukutome et al. | 277/235 A |
| 5,606,939 | | 3/1997 | Spath | 123/90.5 |
| 5,692,465 | * | 12/1997 | Sawada et al. | 123/90.16 |
| 5,743,536 | | 4/1998 | Komuro et al. | 277/235 A |
| 5,816,207 | * | 10/1998 | Kadokawa et al. | 123/90.42 |
| 5,934,232 | * | 8/1999 | Greene et al. | 123/90.16 |
| 5,979,384 | * | 11/1999 | Oka et al. | 123/90.42 |

* cited by examiner

*Primary Examiner*—Weilun Lo
(74) *Attorney, Agent, or Firm*—Keith P. Roberson

(57) ABSTRACT

Roller follower assemblies generally reduce frictional losses and wear associated with operating fuel injectors using a cam. Oil helps to reduce wear, but may not remove small particles. Buildup of these small particles may prevent a roller of the roller follower assembly from rotating about an axle pin. In the present invention, a hard coating is disposed between the axle pin and the roller to reduce rolling friction and buildup of small particles.

11 Claims, 2 Drawing Sheets

ROLLER FOLLOWER ASSEMBLY FOR AN INTERNAL COMBUSTION ENGINE

TECHNICAL FIELD

This invention relates generally to a roller follower assembly for a reciprocating engine and more particularly to an axle pin for use with the roller follower assembly.

BACKGROUND ART

Engine manufacturers strive to improve performance of internal combustion engines by maximizing the conversion of chemical energy to mechanical energy. The conversion efficiency may be improved when losses of energy used to overcome friction between moving parts in the engine are reduced. Mechanical design along with oil and other lubricants aid in reducing these losses.

Roller follower assemblies are mechanical design improvements that reduce friction losses between a cam and a rocker arm. Past systems used a sliding contact between the cam and rocker arm. These systems resulted in large frictional losses. Also, these systems experienced increased wear. Roller follower assemblies reduce friction between the cam and rocker arm by changing the sliding contact to a rolling contact. However, roller follower assemblies may still have a problem with wear.

Each roller rotates about an axle pin. Typically, oil reduces sliding friction between a roller and an axle pin. Oil also provides an additional and equally important role of cleaning the engine. Oil along with an oil filter system may remove particles above a particular size. However, the roller and axle pin may ingest smaller particles. At some point these small particles may cause sliding between the roller and axle pin to cease. The interruption in sliding stops the rolling contact between the cam and roller and causes sliding contact between the cam and roller. The sliding contact between the roller and cam may cause a tearing damage at their respective surfaces.

The present invention is directed to overcoming one or more of the problems set forth above.

DISCLOSURE OF THE INVENTION

In one aspect of the present invention a roller follower assembly for an internal combustion engine comprises a roller having a central bore. An axle pin is positioned within the central bore. A hard coating is disposed between the axle pin and the roller.

In another aspect of the present invention a method for improving wear of a roller follower assembly on an internal combustion engine includes lubricating an axle pin and a roller. Particles present during the lubricating step are reduced. Remaining particles are pulverized between the axle pin and the roller.

BEST MODE FOR CARRYING OUT THE INVENTION

Figure 1:
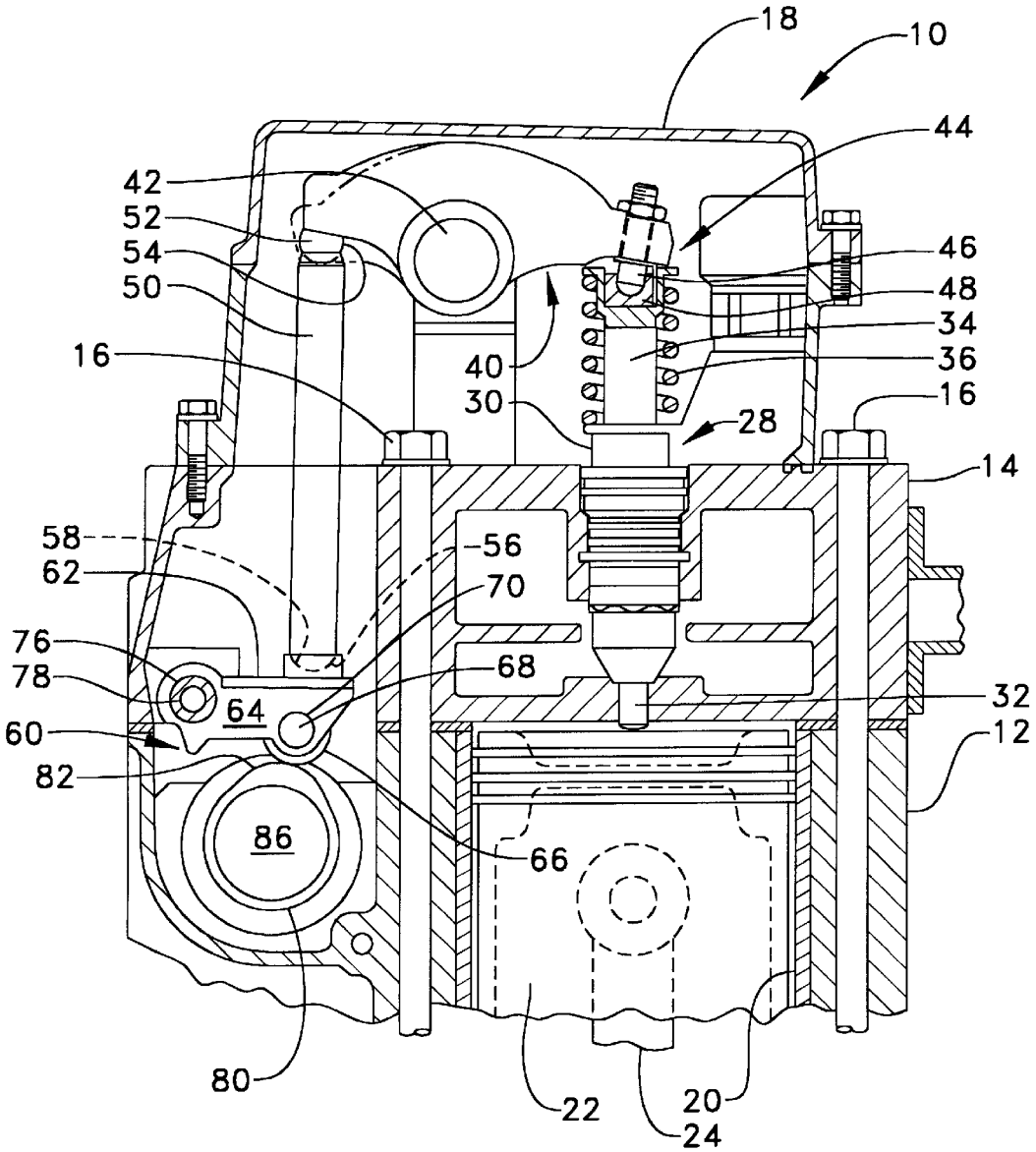
FIG. 1 illustrates an internal combustion engine embodying the present invention.

Referring to FIG. 1, the engine assembly 10 includes an engine block 12, a cylinder head 14 attached to the engine block 12 via a plurality of bolts 16, and a valve cover 18 attached to the cylinder head 14. A plurality of cylinders 20 are formed in the engine block 12, and a piston 22 is disposed for reciprocating movement within each of the cylinders 20. Each piston 22 is coupled to a crankshaft (not shown) via a connecting rod 24. A fuel injector 28 is disposed to periodically inject fuel into each cylinder 20. Each fuel injector 28 includes a body 30, a nozzle 32, a vertically reciprocable plunger 34, and a spring 36 for biasing the plunger 34 upwards.

A rocker arm 40 pivotally mounted on a shaft 42 is associated with each fuel injector 28. Each rocker arm 40 has a first end mechanically coupled to the top of the fuel injector plunger 34 in some conventional manner. The present application shows mechanical coupling via a coupler 44 in the form of a pin 46. The pin 46 is disposed within a cup-shaped receptacle 48 located in a cylindrical bore formed in the top of the plunger 34. Each rocker arm 40 has a second end mechanically coupled to a vertically disposed pushrod 50 via a pin 52 having a spherical head 54. An upper end of the pushrod 50 has a concave surface 56 conformed to the shape of the spherical head 54. A lower end of the pushrod 50 has a convex surface 58 which is attached to a roller follower assembly 60.

The roller follower assembly 60 has a roller 66 that is generally cylindrical. The roller 66 in this application is made from a high carbon alloy steel such as from about 0.9–1.1% by weight carbon. An axle pin 68 passes through a central bore 70 of the roller 66. The axle pin 68 is preferably made of a material similar to the roller 66. Other hard metallic materials may also be used. In this application, the roller follower assembly 60 is supported by a cylindrical shaft 76 passing through a pivot bore on the left end of the roller follower assembly 60. The cylindrical shaft 76 has a hollow central portion 78. The roller 66 engages and follows a cam 80. The cam 80 has a raised portion or cam lobe 82. A camshaft 86 is disposed within a bore through the cam 80. Other configurations may have the roller follower assembly 60 attached directly to the rocker arm 40. Also, the rocker arm 40 may be attached to operate valves (not shown) instead of the fuel injector 28.

Figure 2:
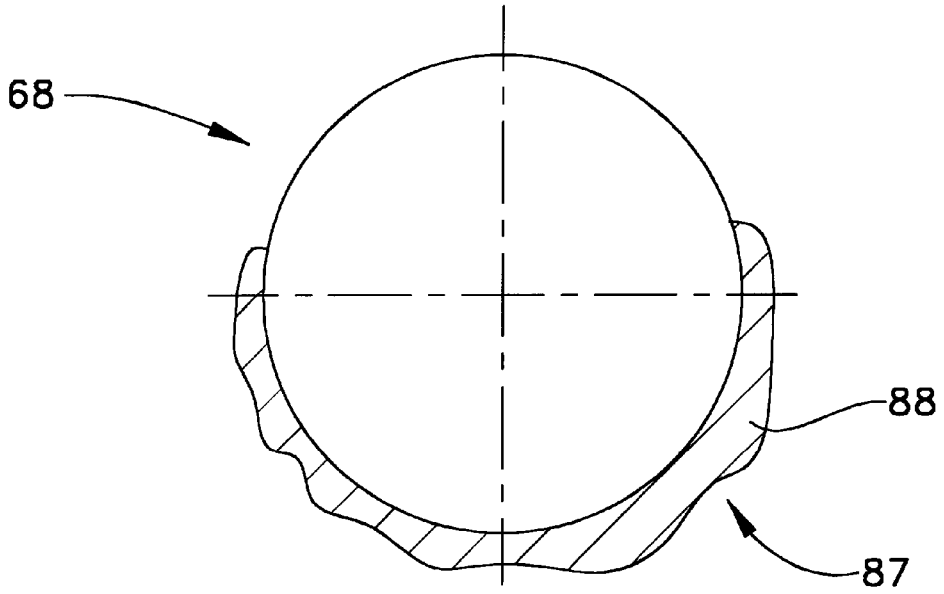
FIG. 2 illustrates a view of one embodiment of an axle pin in accordance with the present invention.

FIG. 2. shows a load bearing surface 87 of the axle pin 68 having a hard coating 88 applied thereto. In this application, the hard coating 88 is applied to a load bearing portion of the axle pin 68. In the preferred embodiment the hard coating 88 is chromium nitride (CrN). However, other hard coatings may also be used including diamond-like carbons (DLC)like tungsten carbide carbon (WCC). As applied, the hard coating 88 should have a hardness of about 60–100 Rockwell C and preferably about 80–90 Rockwell C. A thickness of the hard coating 88 should be between less than about 5 $\mu$m and preferably about 3 $\mu$m. The hard coating 88 should have good adhesion to the axle pin 68. Although not shown, it would be equally advantageous to apply the hard coating 88 to at least the bore of the roller 66. The hard coating 88 is applied, in this application, using an arc vapor deposition (AVD) process known to those in the industry. However, other conventional methods such as chemical vapor deposition, physical vapor deposition, and other coating methods may be used.

INDUSTRIAL APPLICABILITY

In operation, during each revolution of the camshaft 72 and the cam lobe 82 forces the roller 66, the roller follower assembly 60, and the pushrod 50 upwards. The upwards movement of the upper end of the pushrod 50 causes the rocker arm 40 to rotate in a clockwise direction, causing the right-hand end of the rocker arm 40 to force the fuel injector plunger 34 downwards, causing fuel to be injected from the nozzle 32 into the cylinder 20. As the cam lobe 82 rotates past the roller 66, the roller follower body 64 pivots downwardly about the shaft 76. As the downward movement of the roller follower assembly 60 continues, the pushrod 50 begins to move downwards, the rocker arm 40 pivots in a counter-clockwise direction, and the fuel injector plunger 34 moves upwards under the force of the spring 36.

During this operation, the roller 66 maintains sliding contact with the axle pin 68. Oil lubricates this contact. Oil may also carry contaminates and particles from other parts of the engine 10. The hard coating 88 on the axle pin 68 prevents particles from penetrating the surface of the axle pin 68. Instead, as the particles deposit on the surface of the axle pin, the roller 66 and axle pin 68 provide forces sufficient to pulverize the particles. The hard coating 88 also reduces sliding friction between the axle pin 68 and roller 66.

What is claimed is:

1. A roller follower assembly for an internal combustion engine, said roller follower assembly comprising:

a roller being generally cylindrical and having a central bore therethrough;

an axle pin being generally cylindrical and positioned within said central bore, said roller being adapted to rotate about said axle pin; and a hard coating being disposed between said axle pin and said roller, said hard coating being adapted to prevent surface wear of said roller and said axle pin, wherein said hard coating is selected from a group of CrN, $Cr_2N$, TiN, DLC, and mixtures thereof.

2. The roller follower assembly as specified in claim 1 wherein a hardness of said hard coating being about 60–100 Rockwell C.

3. The roller follower assembly as specified in claim 1 wherein said hard coating being applied by an arc vapor deposition process.

4. The roller follower assembly as specified in claim 1 wherein said hard coating having a thickness of less than about 5 $\mu$m.

5. The roller follower assembly as specified in claim 1 wherein said hard coating having a thickness of about 3 $\mu$m.

6. The roller follower assembly as specified in claim 1 wherein said hard coating being applied to at least a portion of said axle pin.

7. The roller follower assembly as specified in claim 6 wherein said portion being a load bearing portion of said axle pin.

8. The roller follower assembly as specified in claim 1 wherein the axle pin being made of a hardened steel.

9. A method for improving wear of a roller follower assembly on an internal combustion engine comprising the steps of:

lubricating an axle pin and a roller, said lubricating reducing sliding friction;

reducing particles present during said lubricating; and pulverizing remaining particles between said axle pin and said roller.

10. The method for improving wear as specified in claim 9 further comprises the step of preventing the particles from penetrating the axle pin.

11. The method for improving wear as specified in claim 10 wherein said preventing step being applying a hard coat to at least a portion of said axle pin.

* * * * *